US006848185B2

(12) United States Patent
Tebo

(10) Patent No.: US 6,848,185 B2
(45) Date of Patent: Feb. 1, 2005

(54) UTILITY KNIFE

(76) Inventor: Glenn J. Tebo, P.O. Box 754, Kingston, NH (US) 03848

( * ) Notice: Subject to any disclaimer, the term of this patent is extended or adjusted under 35 U.S.C. 154(b) by 0 days.

(21) Appl. No.: 10/346,963

(22) Filed: Jan. 17, 2003

(65) Prior Publication Data

US 2004/0139614 A1 Jul. 22, 2004

(51) Int. Cl.[7] ..... B26B 5/00; B26B 1/08

(52) U.S. Cl. ..... 30/162; 30/335; 30/125; 30/320; 30/2; 30/346.55; 30/353; 30/351; 30/339

(58) Field of Search ..... 30/125, 162, 335, 30/299, 337, 339, 342, 152, 329, 320, 353, 355, 346.56, 346.55, 346.5, 346.57, 357, 346.51, 151, 351, 314, 2, 118, 120

(56) References Cited

U.S. PATENT DOCUMENTS

| | | | | | |
|---|---|---|---|---|---|
| 1,748,637 | A | * | 2/1930 | Crum | 30/162 |
| 2,105,663 | A | * | 1/1938 | Laverty | 30/162 |
| 2,286,047 | A | * | 6/1942 | Young | 30/346.59 |
| 2,569,080 | A | * | 9/1951 | Trimble et al. | 30/320 |
| 2,676,406 | A | * | 4/1954 | Hoke | 30/320 |
| 3,171,201 | A | * | 3/1965 | Carifi | 30/335 |
| 3,316,635 | A | * | 5/1967 | West et al. | 30/162 |
| 3,708,881 | A | * | 1/1973 | Bennett | 30/320 |
| 3,879,847 | A | * | 4/1975 | Roll | 30/162 |
| 3,943,627 | A | * | 3/1976 | Stanley, Jr. | 30/151 |
| 4,109,380 | A | * | 8/1978 | Anderson | 30/162 |
| 4,761,882 | A | * | 8/1988 | Silverstein | 30/162 |
| 5,012,581 | A | * | 5/1991 | Fletcher et al. | 30/162 |
| 5,230,152 | A | * | 7/1993 | Kennedy | 30/162 |
| 5,644,843 | A | * | 7/1997 | Young | 30/124 |
| 5,720,105 | A | * | 2/1998 | Gates | 30/353 |
| 5,806,189 | A | | 9/1998 | Bailey | 30/125 |
| 5,906,049 | A | * | 5/1999 | Butts | 30/125 |
| 5,960,544 | A | | 10/1999 | Beyers | 30/125 |
| 6,192,589 | B1 | * | 2/2001 | Martone et al. | 30/125 |
| 6,550,144 | B1 | * | 4/2003 | Berns | 30/162 |

* cited by examiner

*Primary Examiner*—Boyer D. Ashley
(74) *Attorney, Agent, or Firm*—Grossman, Tucker, Perreault & Pfleger, PLLC

(57) ABSTRACT

A utility knife including: a body defining an interior cavity, and a blade carriage slidably disposed within the cavity. The blade carriage is configured for removably receiving at least one blade, and is at least partially slidably removable from the cavity, thereby allowing facile replacement of the blade. In one embodiment, the carriage may receive first and second blades, each of which is extensible from an associated end of the body. A utility knife blade including dual cutting edges and cutting points is also provided.

17 Claims, 5 Drawing Sheets

UTILITY KNIFE

FIELD OF THE INVENTION

The present invention relates generally to utility knives, and more particularly to retractable blade utility knives.

BACKGROUND OF THE INVENTION

Utility knives have been used in the construction field as well as other fields for numerous purposes. Typically, utility knives include a handle with a razor blade mounted to a sliding beam. An external button is coupled to the sliding beam. As the button is depressed and pushed forward by the user's thumb, the blade extends out of the handle for use. When the button is depressed and moved rearward by the user's thumb, the blade is retracted within the handle.

Over time, the blade becomes worn and must be replaced. Utility knives typically include handles made of two separate casing. The casings are held together by a single screw. To replace the worn blade, the screw is removed and the handles are pulled apart. Replacement blades are stored within the handle. The worn blade is removed from the sliding beam and a new blade is inserted in the sliding beam. The worn blade can then be disposed of or placed in the storage cavity in the handle. The casings are then fit together and the screw is replaced.

It has been found that it can be difficult on a job site to open the handle of a utility knife. In particular, a proper screw driver is required to remove the screw. Once the screw is removed, it may be difficult to handle both parts of the casing as well as the screw and the blades since there is not likely to be a convenient flat work surface, such as a table. Further, different tasks require different blades. At times, it is desirable to have a straight cutting surface. At other times, it is desirable to have a hooked cutting surface. While various blades can be carried in the storage container in the handle and replaced when needed, this can be time consuming and awkward on a particular job site.

Accordingly, there is a need for a utility knife configured to allow facile removal and replacement of worn blades while providing convenient and reliable operational performance.

SUMMARY OF THE INVENTION

Consistent with the present invention, there is provided a utility knife including a body defining an interior cavity having an opening. A blade carriage configured for removably receiving a blade is disposed at least partially within the cavity. The blade carriage is at least partially slidably removable from the opening of the cavity, thereby allowing facile replacement of the blade.

According to another aspect of the invention, there is provided a utility knife including a body defining an interior cavity and having a first opening at first end of the body and a second opening at a second end of the body. A blade carriage configured for removably receiving a first blade and a second blade is disposed at least partially within the cavity. The blade carriage is slidably moveable within the cavity between a first position wherein the first blade extends from the first opening and second position wherein the second blade extends from the second opening.

According to another aspect of the invention, there is provided a blade for a utility knife including a generally rectangular body; first and second cutting edges at opposed sides of the rectangular body; and first and second cutting points on at least one end of the body. The first cutting point is coincident with the first cutting edge and the second cutting point is coincident with the second cutting edge.

BRIEF DESCRIPTION OF THE DRAWINGS

Advantages of the present invention will be apparent from the following detailed description of exemplary embodiments thereof, which description should be considered in conjunction with the accompanying drawings, wherein.

DETAILED DESCRIPTION

According to the present invention, a utility knife is provided having a retractable blade. The retractable blade may be carried on a blade carriage that is slidably disposed within a body of the utility knife. The blade of the utility knife may be removed or replaced by sliding the blade carriage at least partially out of the body of the utility knife. When the blade carriage is at least partially removed from the body of the utility knife, the blade is sufficiently exposed to permit removal and/or replacement of the blade from the blade carriage.

Figure 1:
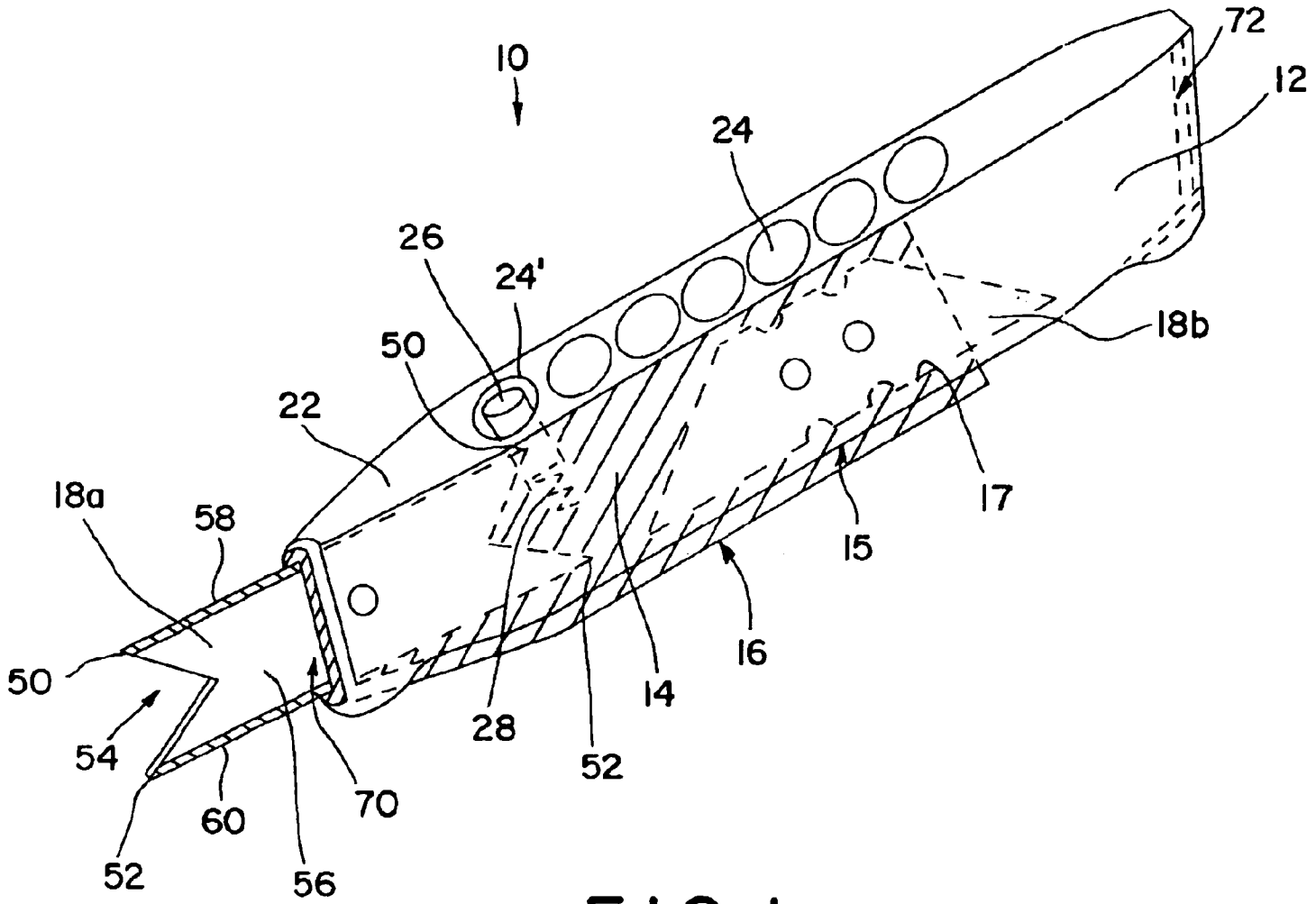
FIG. 1 is a perspective view of a first embodiment consistent with present invention.
Figure 2:
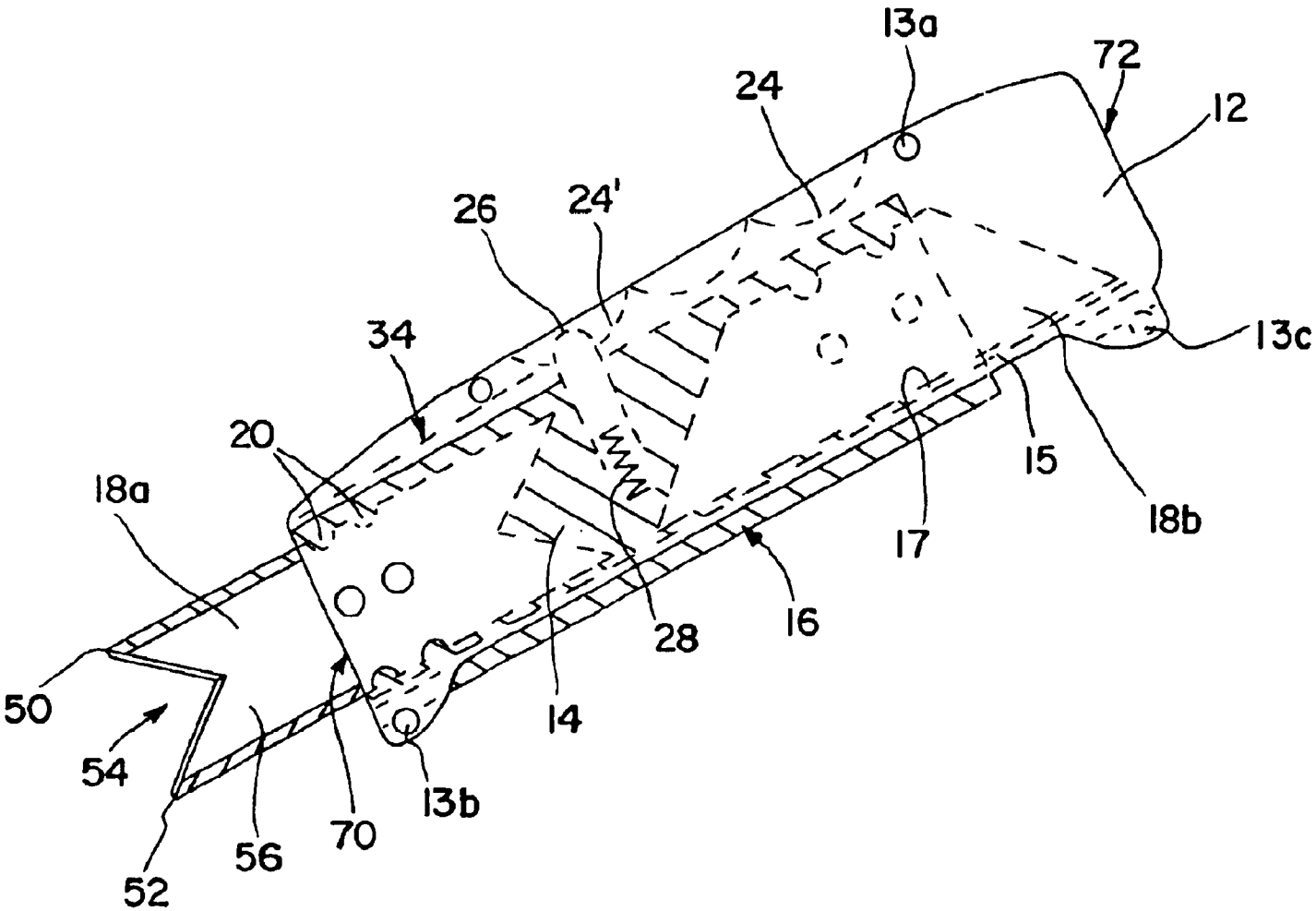
FIG. 2 is a side orthographic view of the embodiment illustrated in FIG. 1.
Figure 3:
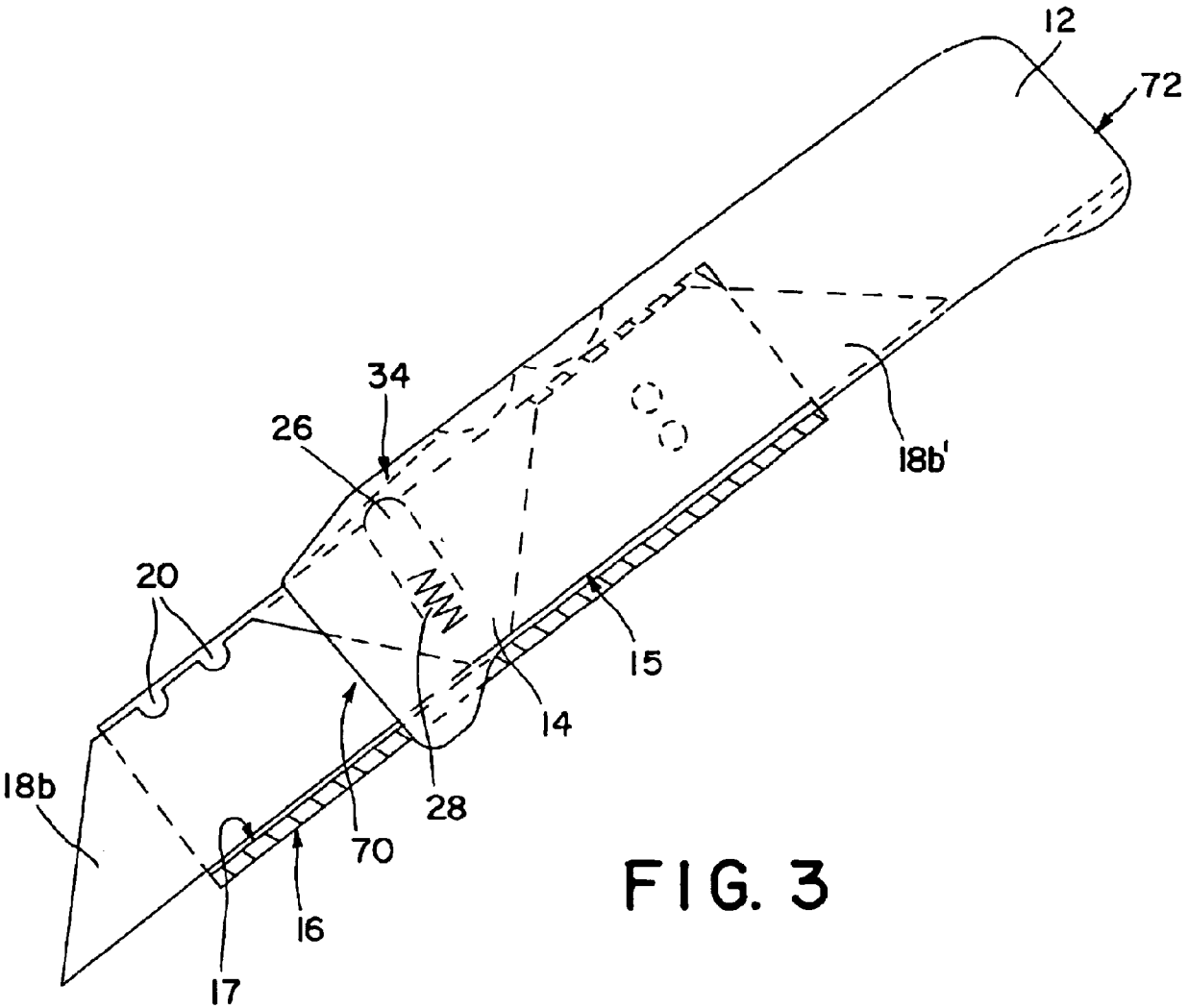
FIG. 3 is a side orthographic view of the embodiment illustrated in FIG. 1 illustrating the removable aspect of the blade carriage.

Turning to the drawings, FIGS. 1 through 3 illustrate a first exemplary embodiment of a utility knife consistent with the present invention. The illustrated utility knife 10 includes a longitudinal body 12 that serves as the handle for the utility knife. The body 12 of the utility knife defines an interior cavity, and may be manufactured as a single unitary piece or may be composed of two shells joined by screws or rivets 13*a–c*, as shown in the illustrated exemplary embodiment.

Disposed within the interior cavity defined by the body 12 is a blade carriage 14, illustrated in broken lines in the drawings. The blade carriage 14 is configured such that one or more cutting blades 18*a*, 18*b* may be removeably retained to the blade carriage 14. The blades 18*a*, 18*b* may be removeably retained to the blade carriage 14 by detents 20 that mate with matching cutouts along the top of the blade. The blade carriage 14 is, itself, disposed within the body 12 such that the blade carriage 14 may slide along the longitudinal axis of the body 12. The sliding action of the blade carriage 14 permits at least one of the blades to be extended from, or retracted into the body 12.

The carriage 14 may be supported in the body by longitudinal guides 17 extending from the sides of the blade carriage. For convenience and ease of illustration, only one guide 17 on one side of the carriage is illustrated. It is to be understood, however, that the opposite side of the carriage may have identical configuration.

The guides 17 on either side of the carriage may be configured to slidably rest on associated longitudinal shelves 15 extending inward from the interior surface of the body, with a bottom 16 of the carriage 14 extending from the body 12. In the illustrated exemplary embodiment, engagement of the guides 17 of the blade carriage 14 and the shelves 15 in the body 12 facilitates the sliding action of the blade carriage within the body and helps to stabilize the blade carriage 14 against forces that may be applied to the blade 18. It will be recognized by those skilled in the art that these advantages may be achieved without the bottom edge 16 actually protruding from the body 12. Accordingly, the bottom edge 16 may simply extend flush with, or even be slightly recessed relative to the bottom of the body 12.

Those skilled in the art will recognize that the sliding movement of the blade carriage 14, as well as stabilization of the blade, may be achieved through a variety of body and carriage configurations. Alternative embodiments may include various interacting or mating track features. Exemplary mating track features may include tongue and groove track features permitting controlled sliding of the blade carriage relative to the body 12. Similarly, respective coordinating ribs on the blade carriage 14 and the interior cavity of the body 12, as well as dovetail features and various other rib and slot configurations may be provided. Providing the body 12 with internal ribs that correspond to the exterior geometry of the blade carriage 14 may be used to achieve similar results.

The top surface 22 of the body 10 may include a number of detent openings 24 configured to receive a spring loaded locking member 26 to secure the blade 18 at various positions of extension or retraction. The locking member 26 may be coupled to the blade carriage 14, such as by being partially contained in an associated bore in the blade carriage 14. A spring 28 may be provided to bias the locking member 26 upward, such that when the locking member 26 is aligned with one of the detent openings 24, the locking member will be at least partially received in the detent opening. In this manner, the locking member 26 may bridge the blade carriage 14 and the body 10, inhibiting movement of the blade carriage 14 relative to the body 10.

As illustrated in FIGS. 2 and 3, the detent openings 24 may include depressions on the exterior of the body 10. The depressions facilitate actuation of the locking member 26, as by a user's thumb. Further, the depressions allow the locking member to be easily actuated without extending above the top surface 22 of the body, minimizing the likelihood of accidentally unlocking the blade.

Alternatively, the detent openings 24 may be connected by a groove or channel, not shown, extending longitudinally along the top surface 22 of the body 12. When the locking member 26 is depressed against the spring bias sufficiently to disengage the locking member 26 from the locking detent openings 24, at least a portion of the locking member may be flush with the top surface 22 of the body. Accordingly, the locking member 26 can be depressed to allow movement of the blade carriage 14 relative to the body 12, and then be acted on to slide the blade carriage 14 into a further extended or further retracted position.

The top of the locking member 26 may be conical, hemispherical, etc., whereby a central portion of the locking member 26 or slider 30, which rides in the groove or channel, protrudes higher than a peripheral portion of the locking member, which engages locking detent openings 24. Providing the locking member 26 flush with, or slightly recessed below the top surface 22 of the body may also reduce any preferential sense of "right-side-up" for the utility knife. This may allow more comfortable handling of the utility knife 10 in different positions.

Figure 4:
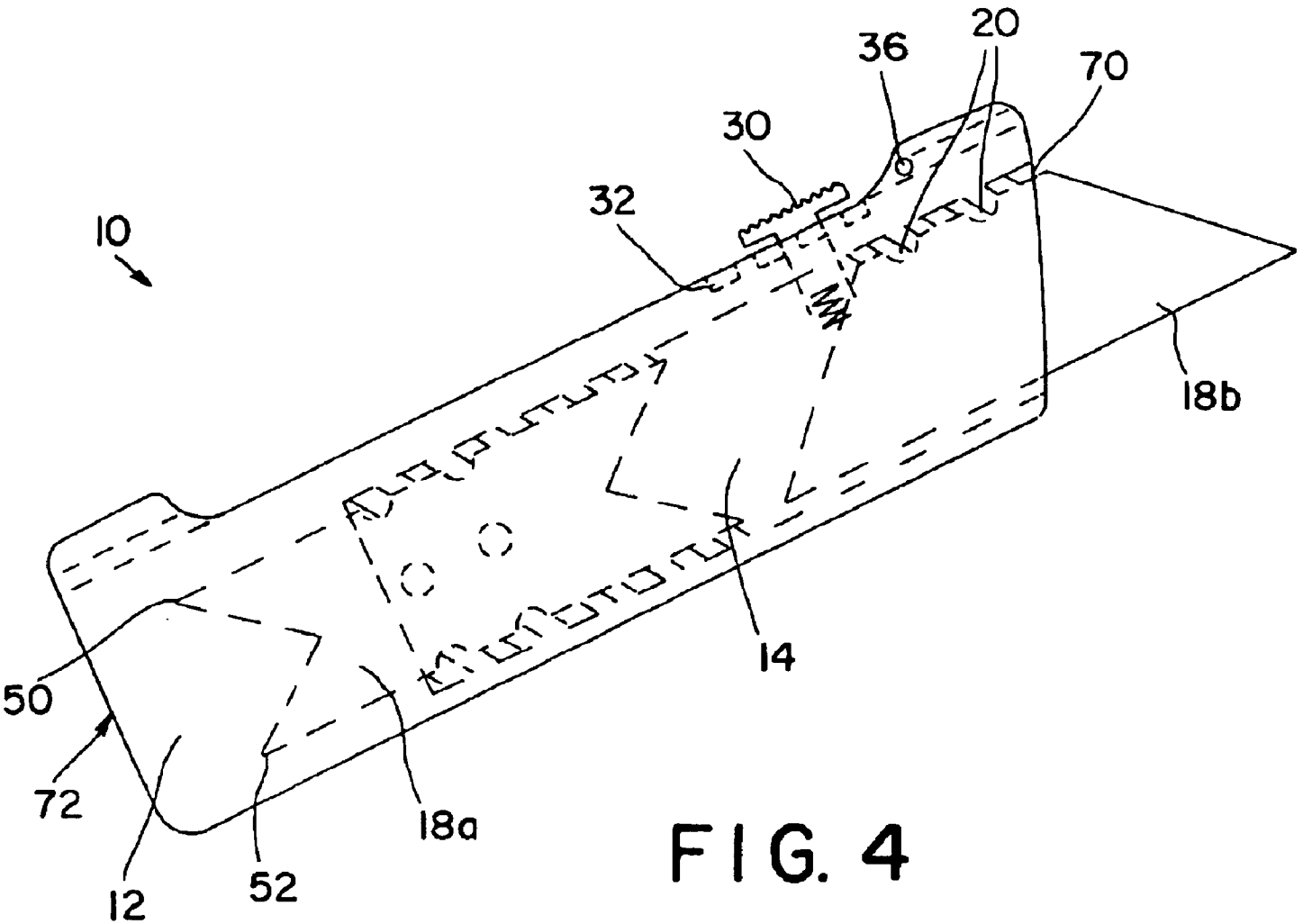
FIG. 4 is a side orthographic view of an alternative embodiment consistent with the present invention.

This aspect may be especially advantageous when using a double edged blade 18*a* consistent with the invention, as illustrated in FIGS. 1, 2, and 4. In the illustrated embodiment, the double edged blade 18*a* includes a generally rectangular body 56, first 58 and second 60 cutting edges on either side of the body, and first and second generally triangular cutting points 50, 52 at each end of the blade 18*a*. The first and second cutting points 50, 52 are each coincident with an associated cutting edge and define a generally triangular cut-out 54 at each end of the rectangular body 56.

Advantageously, a blade 18*a* consistent with the invention may be oriented for cutting with either edge 58, 60. This avoids the need to orient the knife in any right-side-up position, allowing efficient use of the knife in any orientation. In addition, dual cutting edges 58, 60 prolong the useful life of the blade, since a user can easily re-orient the knife to use a sharp edge as one edge dulls. Moreover, the first and second cutting points 50, 52 may be used for cutting, puncturing or scoring a variety of materials.

Turning again to the locking mechanism, those skilled in the art will recognize numerous alternative locking configurations. As shown in FIG. 4, for example, a locking slider 30 may be provided at one side of the knife body 12. The locking slider 30 is coupled with the blade carriage 14 and spring biased upward. In the upwardly biased position, the locking slider 30 interacts with detents 32 to inhibit sliding of the blade carriage 14. Pushing the locking slider 20 downward against the spring 28 clears the locking slider of the detents 32. Applying a sliding force to the locking slider 30 acts on the blade carriage 14, and allows the blade to be moved between a retracted configuration and an extended configuration. As with previous embodiments, there may be several detents 32 allowing the blade to be extended to various degrees. Additionally, the locking slider 30 may include textured features on the outward facing surface, facilitating easier sliding movement of the locking slider 30.

Consistent with the present invention, the blade 18*a*, 18*b* may be removed or replaced by sliding the blade carriage 14 out from the body 12 of the utility knife 10. The blade carriage 14 may be completely removed from the body 12, thereby providing access for removal of the blade 18*a*, 18*b* and/or installation of a new blade. Alternatively, the utility knife 10 may be configured such that the blade carriage 14 need not be fully removed from the body 12 in order to remove or replace the blade 18*a*, 18*b*. The blade carriage 14 may, for example, only be advanced from the body 12 to the point at which detents 20 which retain the blade 18*a*, 18*b*. The exact amount that the blade carriage 14 must be advanced from the body 12 will depend upon how the blade 18*a*, 18*b* is removeably retained to the blade carriage 14. Both complete and partial removal of the blade carriage 14 for the purpose of removing or replacing the blade 18 are herein referred to as "removal" of the blade carriage.

Advantageously, removal of the blade carriage 14 may be accomplished using the same mechanism employed to advance the blade and/or inhibit movement of the blade relative to the body 12. Referring to the embodiment illustrated in FIGS. 1 through 3, with the blade 18*a* in a fully extended position, the locking member 26 may be depressed to release the locking member from the final detent opening 24' and the blade carriage 14 may then be removed from the body 12 through an opening 70 at the end thereof. When the blade carriage 14 is in a removed condition, the blade 18 may be removed or replaced as discussed above.

Turning to the embodiment shown in FIG. 4, removal of the blade carriage 14 may also be accomplished using the locking slider 30, which is used to extend and retract the blades 18*a*, 18*b*. As with the previous embodiment, when the blade 18 is in a fully extended position, the blade carriage 14 may be removed by depressing the locking slider 30 beneath retention pin 36 and advancing the locking slider 30 toward the end of the utility knife 10. Also, as consistent with the previous embodiment, the blade 18 may be removed or replaced when the blade carriage 14 is in a removed condition.

As illustrated in FIGS. 2 and 3, the egress path 34 of the blade carriage 14 adjacent to the locking member 26 may slope inward, i.e., decreasing height as the passage approaches the end of the body 12. The inward slope of the egress path 34 results in an increase in spring compression as the blade carriage 14 is moved toward the end of the body 12. This in turn results in an increase in the amount of force required to extract the blade carriage 14. This feature may be employed to prevent or limit accidental removal of the blade carriage 14 without greatly impeding intentional removal.

According to an alternative embodiment, not illustrated, an additional catch may be employed to prevent the complete extraction of the blade carriage 14. Accordingly, it may be necessary to disengage a second catch for removal of the blade carriage 14. Desirably, removal of the blade carriage 14 may be accomplished one handed, but with reduced occurrence of inadvertent removal. Exemplary additional catch mechanisms may include spring biased catches, snap-fit members, etc.

Advantageously, a utility knife consistent with the invention may be configured to provide a blade 18*a*, 18*b* extensible from one or both ends of the body. The blades may be removably retained at opposite ends to the blade carriage 14, and may be of the same or different types. With reference, for example to FIG. 1, when a first blade 18*a* is in a fully extended position, the second blade 18*b* is in a fully retracted position. Similarly, when the second blade 18*b* is in a fully extended position, the first blade 18*a* is in a fully retracted position. Additionally, it is desirably that when the blade carriage 14 is in a central position relative to the body 12, as shown in FIG. 5, both the first blade 18*b* and the second blade 18*b*' are in a fully retracted position.

Moreover, both blades may be replaced by fully or partially removing the blade carriage from the body. Openings 70, 72 may be provided at each end of the body. Removal of either blade may be accomplished by extending the blade carriage 14 through the opening 70 or 72 at the end of the body 12 adjacent the blade to be removed. The carriage may be slid through the opening just enough to remove the second blade from the blade carriage 14, without fully removing the blade carriage 14 from the body 12, or the blade carriage 14 may be fully removed from the body 12.

Consistent with a further embodiment, a utility knife 10 consistent with the present invention may be provided with a storage feature for holding spare blades. Advantageously, the storage feature may include a recess or a cut-out in the blade carriage 14 that is configured to receive additional blades therein. If the blade carriage 14 is removed from the body 12 in order to replace the blade 18, the additional blades may be accessed at the same time, and in the same manner. Alternatively, the additional blades may be retained in a recess in the body 12. If the additional blades are retained in a recess in the body 12, the blades may be accessed with minimal disassembly of the utility knife 10.

Figure 5:
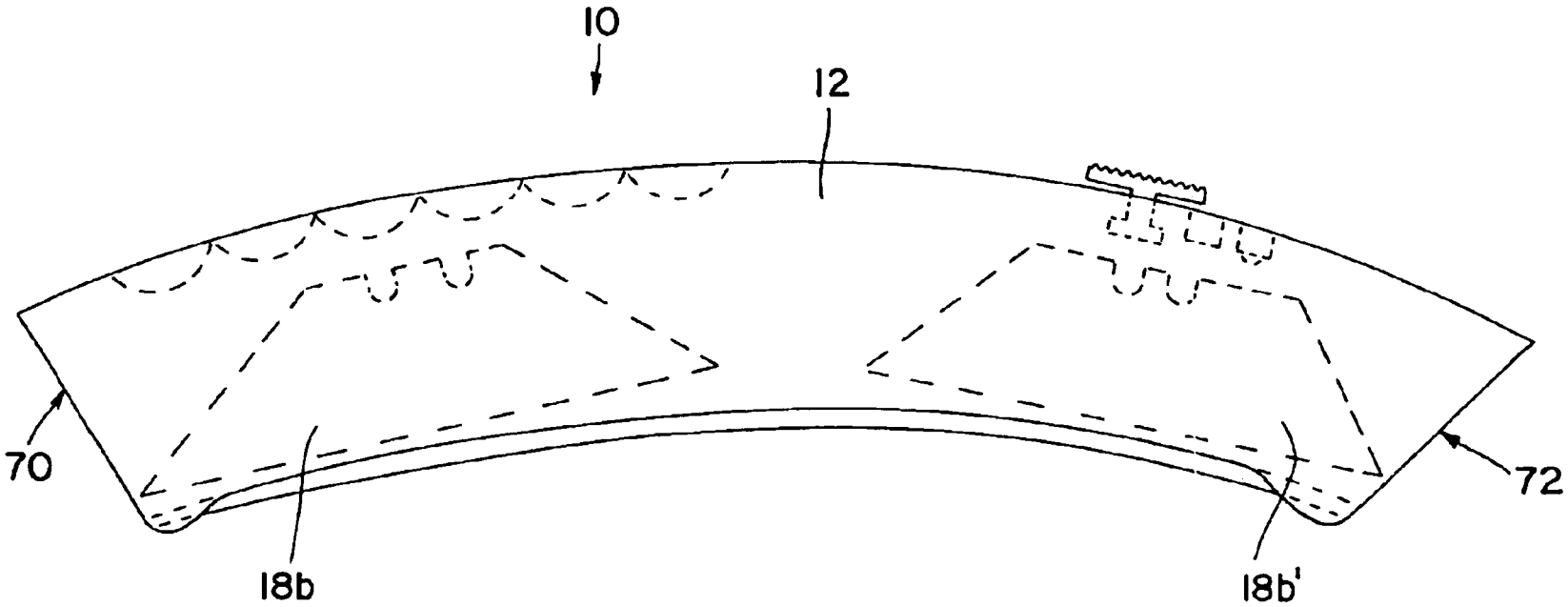
FIG. 5 is a side orthographic view of a further alternative embodiment consistent with the present invention.

Referring to FIG. 5, another embodiment consistent with the present invention is illustrated. According to this illustrated embodiment, the knife 10 may be formed having a curved or generally arcuate shape, thereby providing a more comfortable and ergonomic knife. Depending upon the degree of curvature, the blade carriage (not shown) may travel in either a linear or an arcuate path during both advancement of the blade as well as during removal of the blade carriage for removal or replacement of the blade. As illustrated in hidden lines, the utility knife consistent with this embodiment may be provided with two blades, one advanceable from either end of the utility knife.

Consistent with a further embodiment of the present invention, the blade carriage may be slidably at least partially removable from the body in a direction other than the direction of extension and retraction of the blade. For example, the blade carriage may be inserted into the interior cavity of the body through an opening disposed between the two ends of the body. Once the blade carriage has been inserted into the interior cavity the blade carriage may be slideable about the longitudinal axis of the body, thereby allowing extension and retraction of the blade. In this manner the opening disposed between the two ends of the body allows loading and removal of the blade carriage into the interior cavity in a direction different than the direction of advancement and retraction of the blade, for example perpendicular to the direction of advancement and retraction of the blade.

It should be apparent to those having skill in the art that the various aspects of the individual embodiments disclosed herein are susceptible to combination. Similarly, it should be apparent that the invention herein is susceptible to modification beyond the discussed embodiments without departing from the spirit and scope of the invention laid out in the claims.

What is claimed is:

1. A utility knife comprising:

a body defining an interior cavity having a first and second opening; and a blade carriage configured for removably receiving a first and second blade, said blade carriage being disposed at least partially within said cavity and being at least partially slidably removable from said first and second openings of said cavity, thereby allowing replacement of said first and second blades, said blade carriage being completely slidably removable from at least one of said first and second openings.

2. A utility knife according to claim 1 wherein said first opening is disposed at an end of said body.

3. A utility knife according to claim 1 wherein said body has a generally arcuate shape.

4. A utility knife according to claim 1, wherein said body and said blade carriage comprise mating track features configured to allow sliding movement of said blade carriage within said cavity.

5. A utility knife according to claim 1, wherein said second opening is disposed at a second end of said body.

6. A utility knife according to claim 1 further comprising a lock selectively engageable between said body and said blade carriage for selectively securing said blade carriage in each of a plurality of positions relative to said body.

7. A utility knife according to claim 6 wherein said lock comprises a spring biased member configured to be received in at least one detent opening in said body.

8. A utility knife comprising:

a longitudinal body defining an interior cavity having a first opening at a first end of said body and a second opening at a second end of said body; and a blade carriage slidably received in said interior cavity, said blade carriage configured to removably retain a first blade extending from a first end of said blade carriage and a second blade extending from a second end of said blade carriage, and being at least partially slidably removable from said cavity through at least one of said first and second openings, and said blade carriage being completely slidably removable from at least one of said first and second openings; and a spring biased lock member engageable between said body and said blade carriage for selectively securing said blade carriage in each of a plurality of positions relative to said body.

9. A blade for a utility knife comprising:

a generally rectangular body comprising at least one detent cutout configured for receiving a detent for removably retaining said body to a blade carriage;

first and second cutting edges at opposed sides of said rectangular body, at least one of said first and second cutting edges comprising the at least one detent cutout adapted to mate with detents of a blade carriage; and first and second cutting points at a first end of said body, said first cutting point being coincident with said first cutting edge and said second cutting point being coincident with said second cutting edge, said cutting points defining a generally triangular cutout at said end of said body.

10. A blade according to claim 9, said blade comprising third and fourth cutting points at a second end of said body, said third cutting point being coincident with said first cutting edge and said fourth cutting point being coincident with said second cutting edge.

11. A utility knife comprising:

a knife body defining an interior cavity having an opening; and a blade carriage configured for removably receiving a first blade and comprising at least one detent for removably retaining said blade, said blade carriage being disposed at least partially within said cavity and being at least partially slidably removable from said opening of said cavity, thereby allowing replacement of said first blade;

said first blade comprising a generally rectangular body having first end second cutting edges at opposed sides of said rectangular body, at least one detent cutout configured for receiving said detent, and a first and second cutting point at a first end of said body, said first cutting point being coincident with said first cutting edge and said second cutting point coincident with said second cutting edge, said cutting points defining a generally triangular cutout at said end of said body.

12. A utility knife according to claim 11 wherein said blade comprises third and fourth cutting points at a second end of said body, said third cutting point being coincident with said first cutting edge and said fourth cutting point being coincident with said second cutting edge.

13. A utility knife according to claim 11 wherein said blade carriage is completely slidably removable from said cavity.

14. A utility knife according to claim 11 further comprising a lock selectively engageable between said knife body and said blade carriage for selectively securing said blade carriage in each of a plurality of positions relative to said knife body.

15. A utility knife according to claim 11 wherein said knife body has a generally arcuate shape.

16. A utility knife according to claim 11 wherein said knife body and said blade carriage comprise mating track features configured to allow sliding movement of said blade carriage within said cavity.

17. A utility knife according to claim 11, wherein at least one of said first and second edges comprises at least one cutout adapted to mate with detent of said blade carriage.

* * * * *

UNITED STATES PATENT AND TRADEMARK OFFICE

CERTIFICATE OF CORRECTION

PATENT NO. : 6,848,185 B2
APPLICATION NO. : 10/346963
DATED : February 1, 2005
INVENTOR(S) : Tebo It is certified that error appears in the above-identified patent and that said Letters Patent is hereby corrected as shown below:

Column 8,
Line 5, delete the word "end" and insert the word --and--;

Signed and Sealed this

Twentieth Day of March, 2007

JON W. DUDAS
*Director of the United States Patent and Trademark Office*